US007344413B2

(12) United States Patent
Nishida

(10) Patent No.: US 7,344,413 B2
(45) Date of Patent: Mar. 18, 2008

(54) SHIELDED CONNECTOR

(75) Inventor: Shiro Nishida, Mei (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/088,959

(22) Filed: Mar. 24, 2005

(65) Prior Publication Data

US 2005/0215122 A1 Sep. 29, 2005

(30) Foreign Application Priority Data

Mar. 25, 2004 (JP) ..... 2004-088503

(51) Int. Cl.
*H01R 9/03* (2006.01)

(52) U.S. Cl. ..... 439/610

(58) Field of Classification Search ..... 439/607–610, 439/939, 98–99, 550, 559, 562–564, 555, 439/573, 95, 275; 174/75 C, 78, 74 R, 84 R, 174/88, 86

See application file for complete search history.

(56) References Cited

U.S. PATENT DOCUMENTS 5,429,529 A * 7/1995 Hashizawa et al. ..... 439/610
5,965,847 A * 10/1999 Tanaka et al. ..... 174/84 R
6,053,749 A * 4/2000 Masuda et al. ..... 439/98
6,528,727 B2 * 3/2003 Miyazaki ..... 174/84 R
6,530,789 B2 * 3/2003 Konda ..... 439/98
6,648,690 B2 * 11/2003 Saito et al. ..... 439/610
6,781,059 B2 * 8/2004 Mizutani ..... 174/75 C
6,921,292 B2 * 7/2005 Miyazaki ..... 439/564
2002/0048994 A1 * 4/2002 Oota et al. ..... 439/607

FOREIGN PATENT DOCUMENTS

JP A 2002-313496 10/2002

* cited by examiner

*Primary Examiner*—Edwin A. Leon
(74) *Attorney, Agent, or Firm*—Oliff & Berridge, PLC

(57) ABSTRACT

A shielded connector includes: a shield member having a braided wire that encloses a bundle of a plurality of wires; a shield shell formed by bending a metal plate member into a cylindrical shape and coupling circumferential end edges of the metal plate member; a caulk ring disposed on an outer circumference of the shield shell to hold and fix the shield member between the shield shell by caulking; and an underlay ring that receives caulking force to be applied to the shield shell from an outer circumferential side of the shield shell when the caulking is performed, the underlay ring being disposed on an inner circumference of the shield shell at a position corresponding to the caulk ring.

10 Claims, 9 Drawing Sheets

SHIELDED CONNECTOR

BACKGROUND OF THE INVENTION

1. Field of the Invention

The present invention relates to a shielded connector.

2. Description of the Related Art

Conventionally, there is a shielded connector as described in JP-A-2002-313496. In this shielded connector, a bundle of a plurality of wires is enclosed by a cylindrical shield member comprising braided wires, and the shield member is fixed to a shield shell by caulking as a terminal processing method for the shield member. At the time of caulking, the shield member is placed over the outer circumference of the shield shell, a caulk ring is fitted over the outer circumference of the shield member, and the shield member is held between the caulk ring and the shield shell by caulking.

SUMMARY OF THE INVENTION

In connecting a shield shell to a mating shield member, a structure of forming an elastic contact piece by bending the edge portion of the shield shell in a dense folding form is considered a possible connection means to the mating shield member. To avoid cracking at the dense folding portion of the elastic contact piece, however, the plate of the shield shell should be made thin.

There is a shield shell which is a flat metal plate member bent into a cylindrical shape with its edges being connected together by using an engagement structure of a hole and an engagement piece or the like. When the dense-folded elastic contact piece is formed at the shield shell having such a connecting portion, the connecting portion may be deformed at the time of caulking due to the thin plate thickness of the shield shell, resulting in the occurrence of loosening between the caulk ring and the shield shell so that the shield member is separated from the shield shell.

The invention has been completed based on the above circumstance, and aims at preventing the shield member from falling off the shield shell.

According to one aspect of the invention, there is provided a shielded connector including: a shield member having a braided wire that encloses a bundle of a plurality of wires; a shield shell formed by bending a metal plate member into a cylindrical shape and coupling circumferential end edges of the metal plate member; a caulk ring disposed on an outer circumference of the shield shell to hold and fix the shield member between the shield shell by caulking; and an underlay ring that receives caulking force to be applied to the shield shell from an outer circumferential side of the shield shell when the caulking is performed, the underlay ring being disposed on an inner circumference of the shield shell at a position corresponding to the caulk ring.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Figure 1:
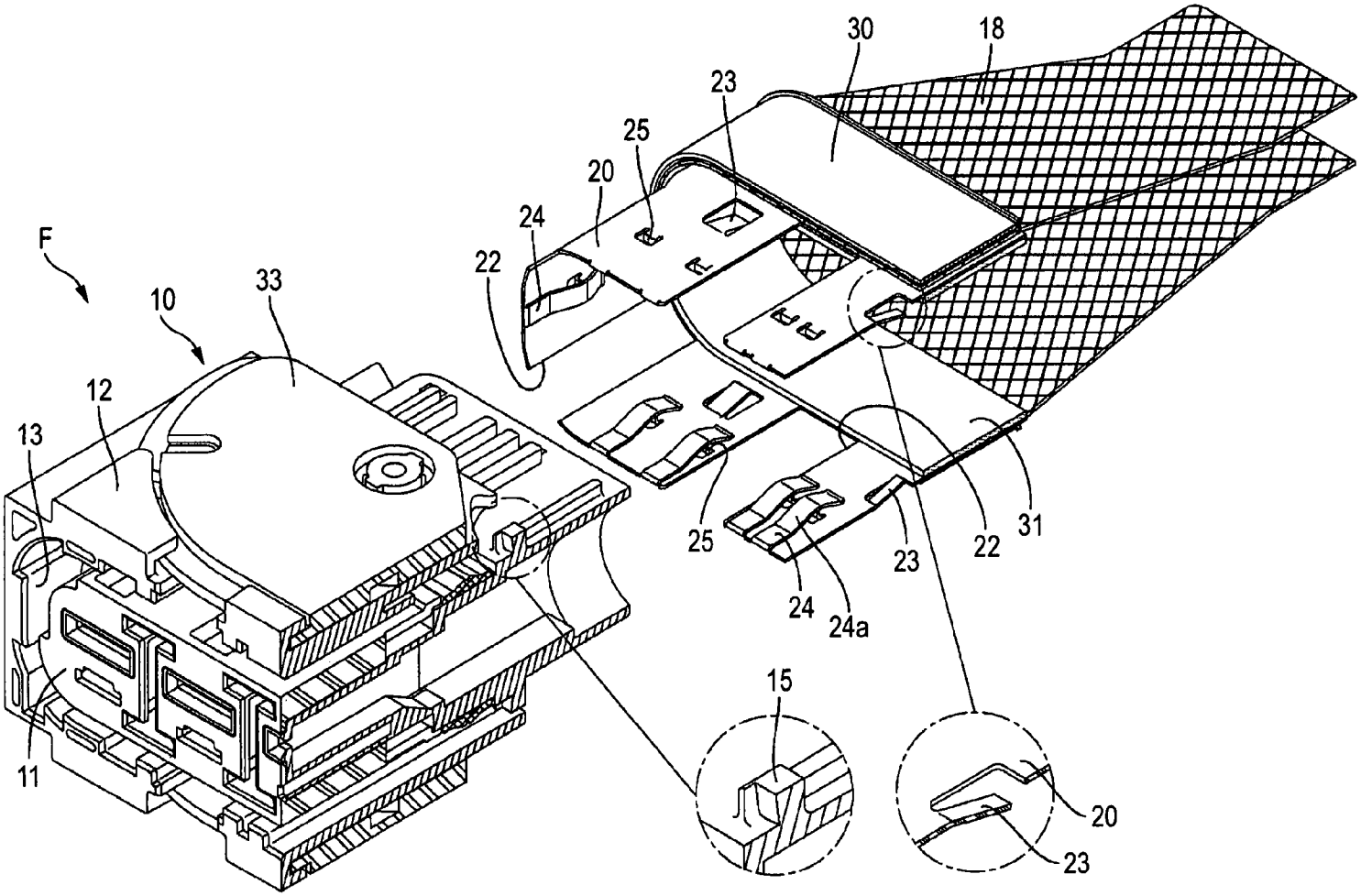
FIG. 1 is a partly cutaway perspective view showing a shield shell separated from a housing.
Figure 2:
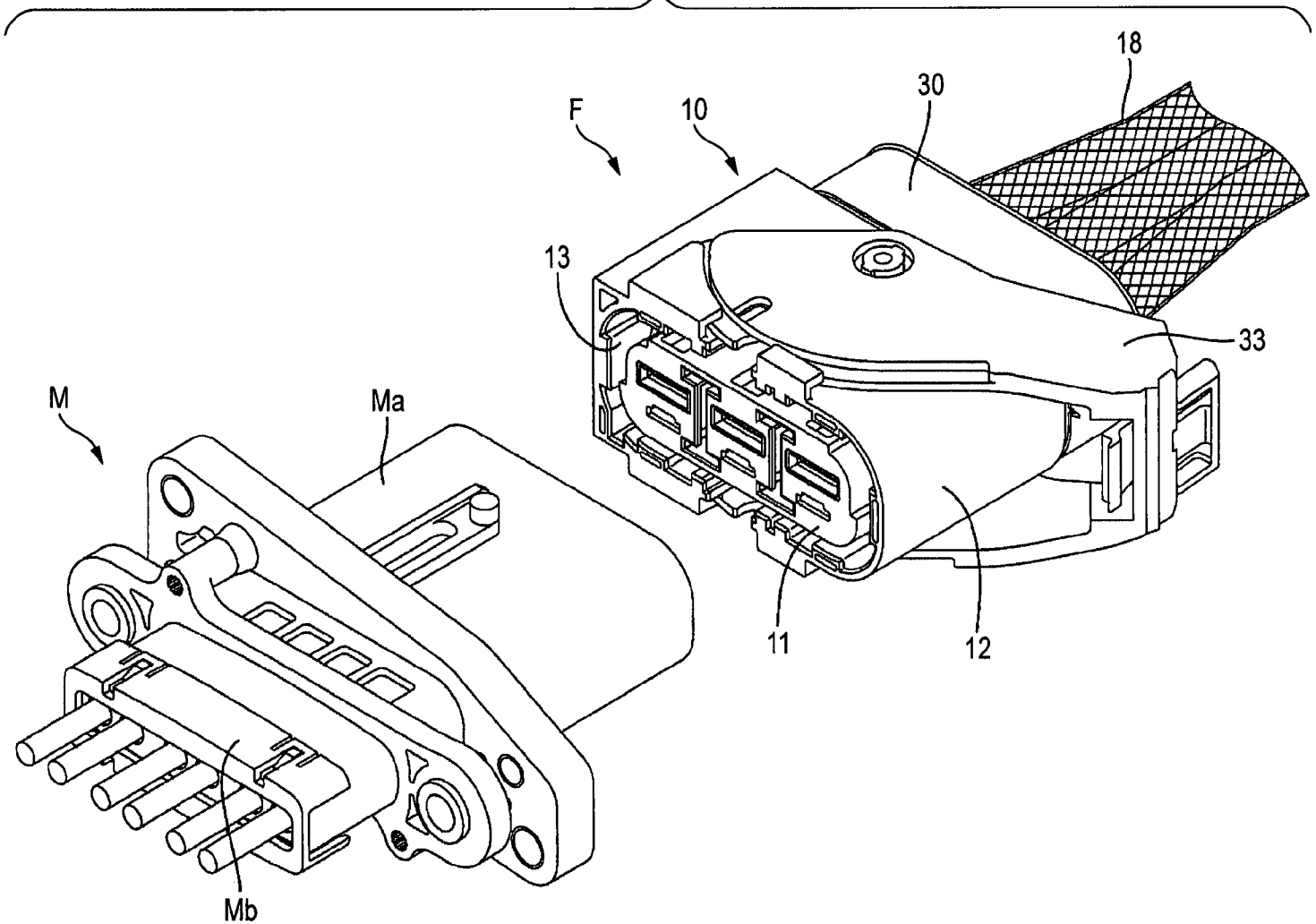
FIG. 2 is a cutaway perspective view showing a shielded connector separated from a mating connector.
Figure 3:
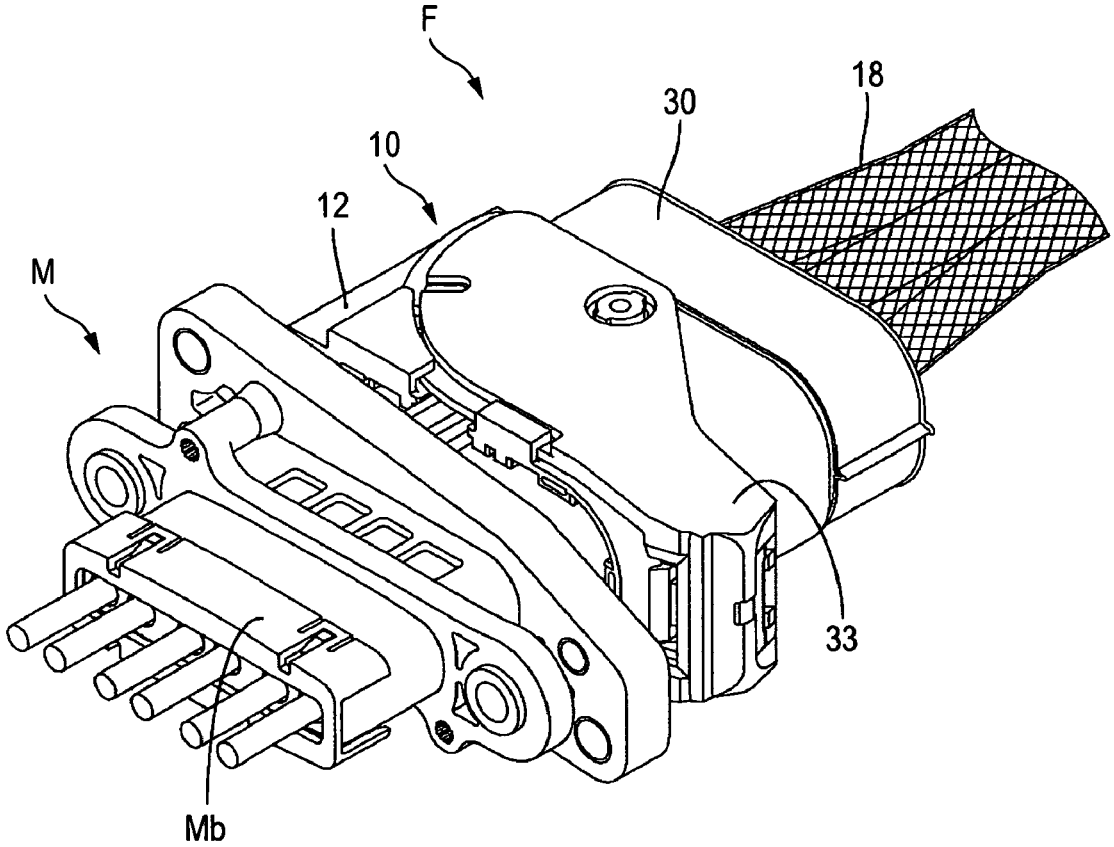
FIG. 3 is a cutaway perspective view showing the shielded connector connected to the mating connector.
Figure 4:
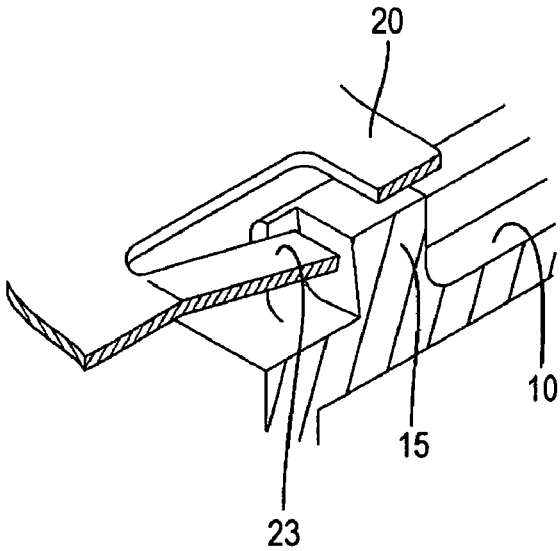
FIG. 4 is a partly cutaway perspective view showing an engagement structure of an elastic engagement piece and a fall-off preventing portion.
Figure 5:
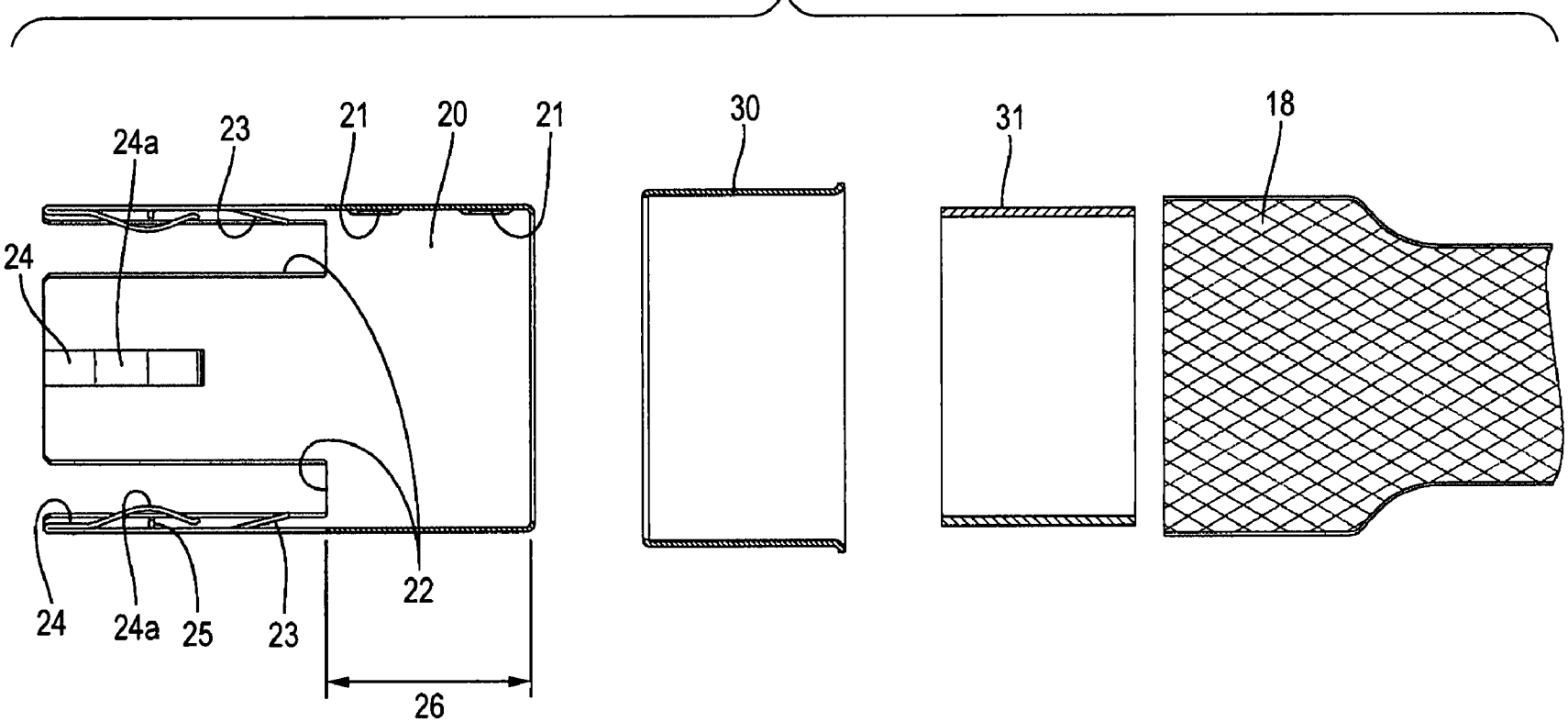
FIG. 5 is a vertical cross-sectional view showing the shield shell, a caulk ring and an underlay ring separated from one another.
Figure 6:
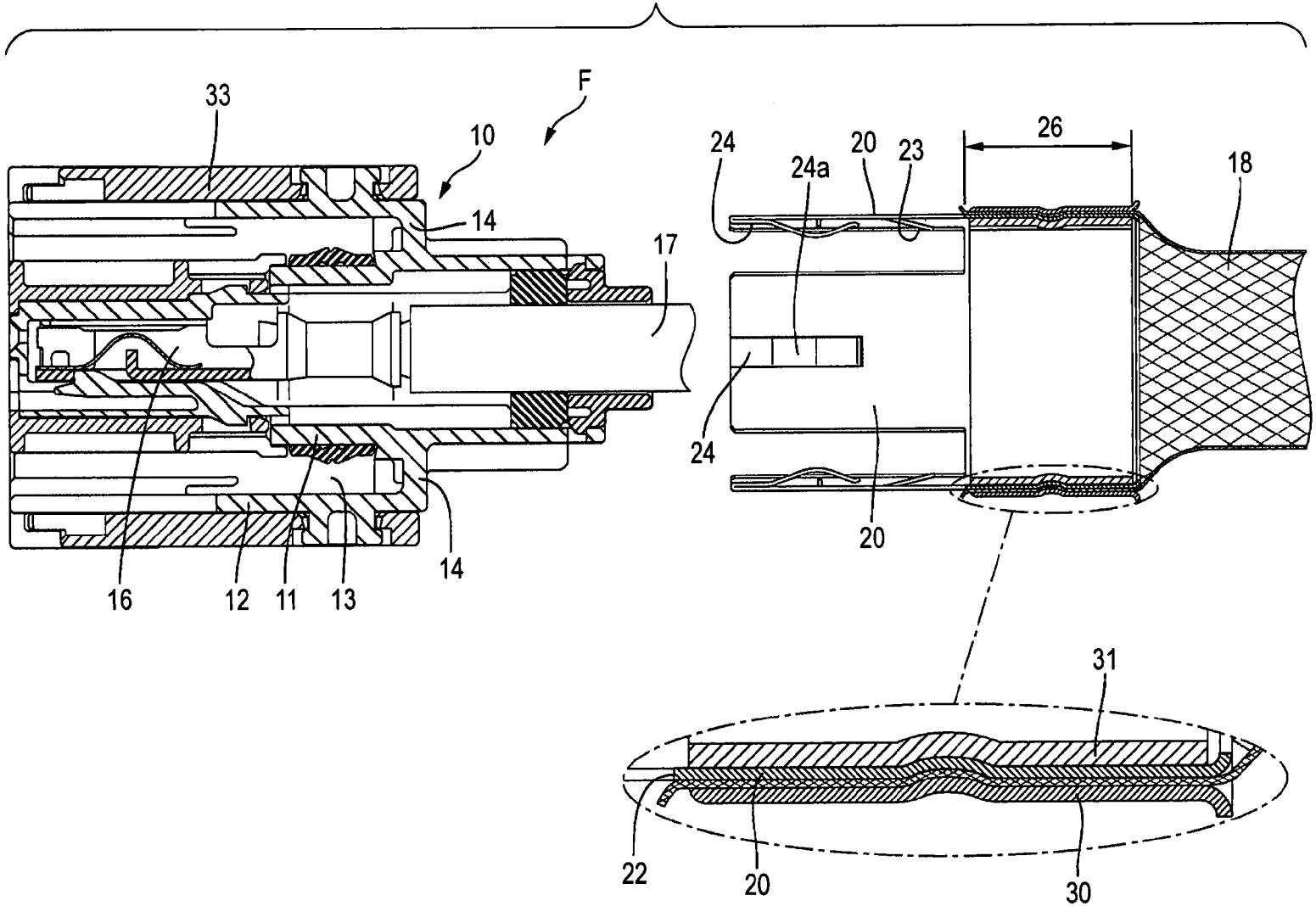
FIG. 6 is a vertical cross-sectional view showing the shield shell separated from the housing.
Figure 7:
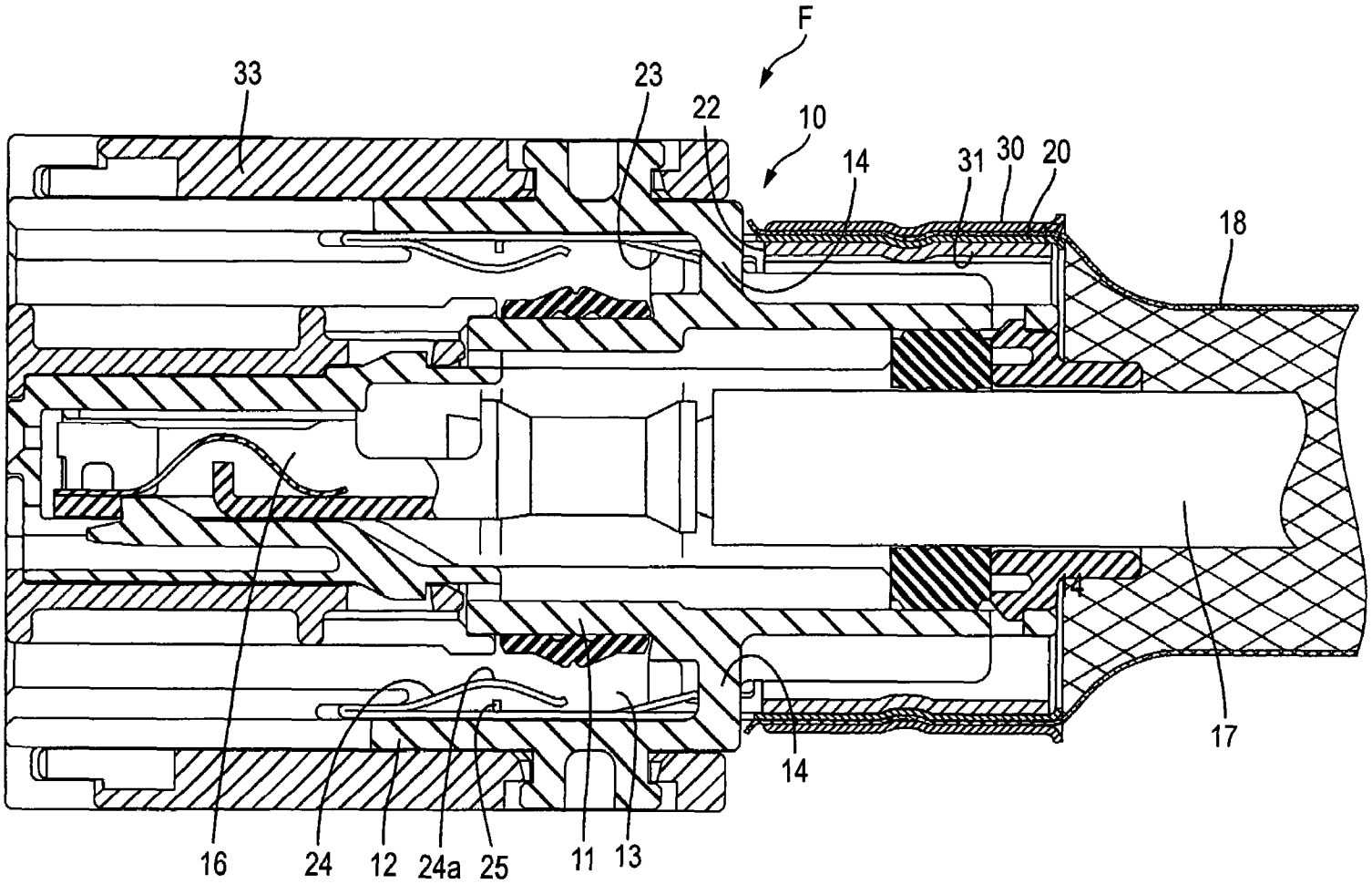
FIG. 7 is a vertical cross-sectional view showing the shield shell connected to the housing.
Figure 8:
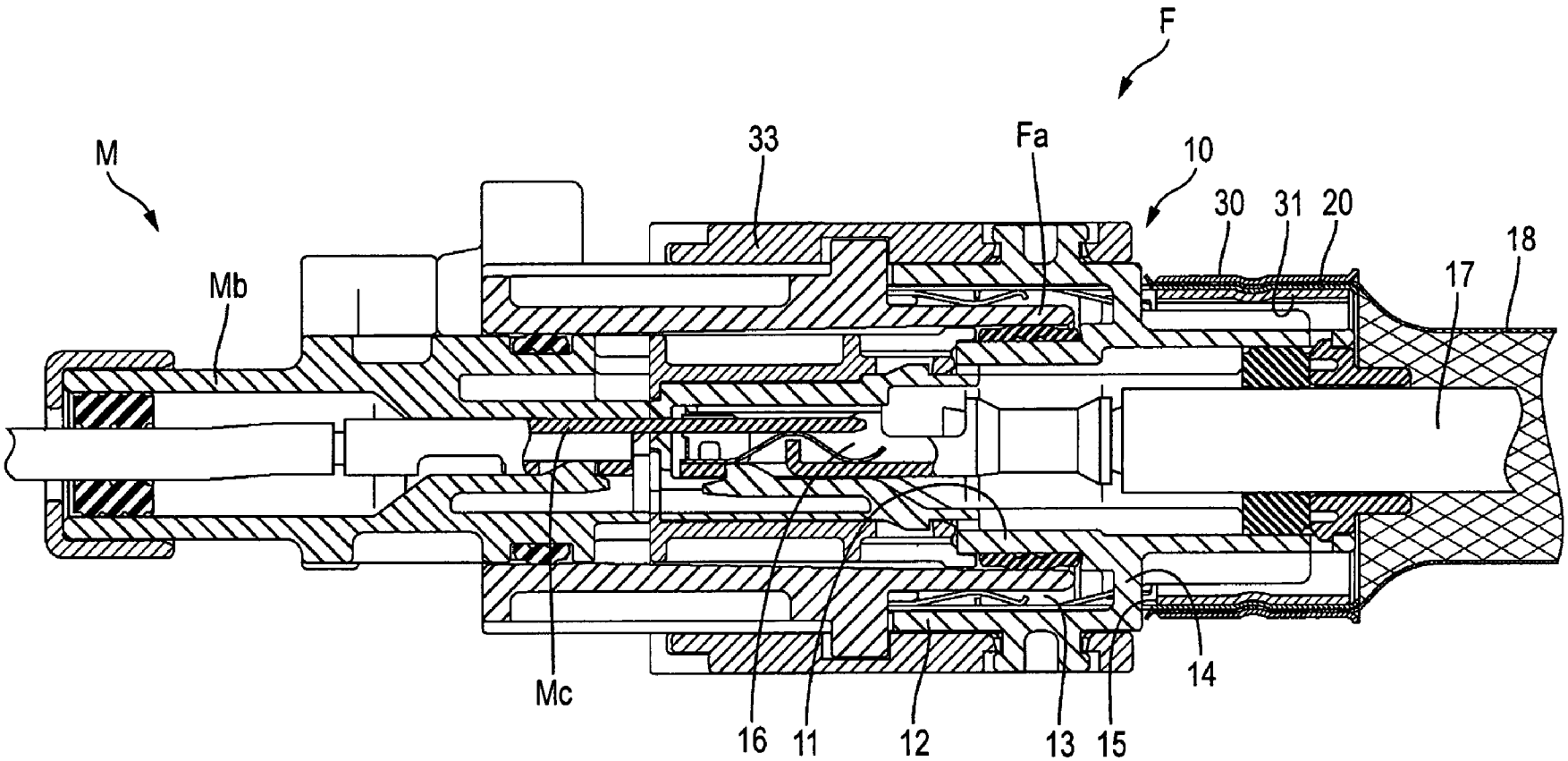
FIG. 8 is a vertical cross-sectional view showing the shielded connector connected to the housing.
Figure 9:
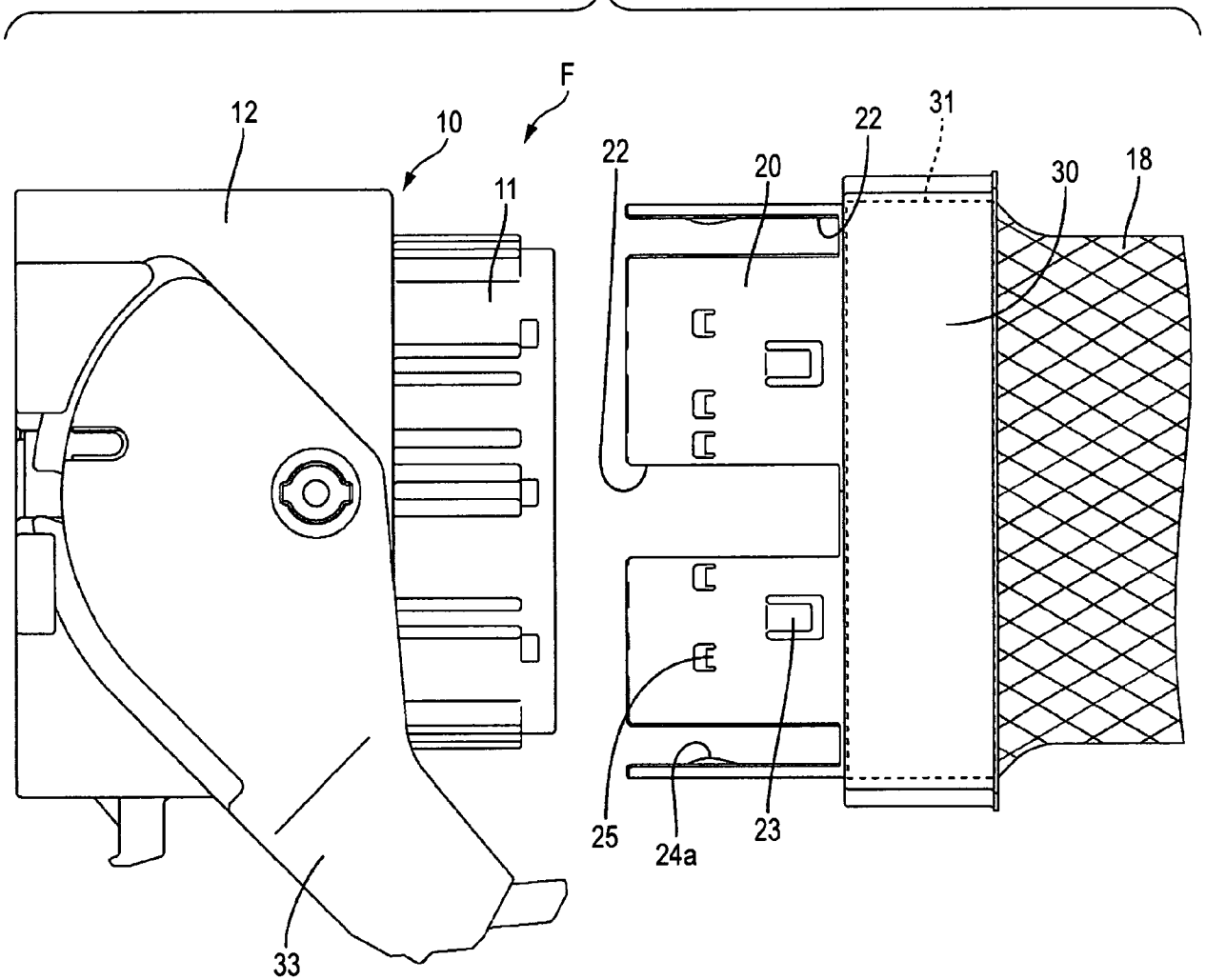
FIG. 9 is a plan view showing the shield shell separated from the housing.

An embodiment of the invention will be described referring to FIGS. 1 to 10B. A shielded connector F according to the embodiment includes a housing 10 made of a synthetic resin, plural terminal fittings 16 (three in the embodiment, but two or four or more may be feasible), wires 17 fixed to the rear end portions of the individual terminal fittings 16, a shield member 18 comprised of a braided wire which encloses a bundle of the wires 17 led rearward from the housing 10, and a shield shell 20 fixed to the leading end portion of the shield member 18.

The housing 10 becomes integrated with a body portion 11 for retaining the terminal fittings 16 and a cylindrical fitting portion 12 enclosing the body portion 11, and attachment space 13 of an approximately quadrangle shape having four corners shaped into quadrant arcs is formed between the body portion 11 and the cylindrical fitting portion 12. A coupling portion 14 which couples the body portion 11 to the trailing end portion of the cylindrical fitting portion 12 is formed at a total of six locations, upper and lower widthwise center positions of the horizontal top and bottom sides on the outer circumference of the body portion 11 and the quadrant arc portions at the four corners of the outer circumference of the body portion 11. A pair of right and left projecting retaining portions 15 are formed at both top and bottom sides so as to position on both right and left sides of the coupling portion 14. The shield shell 20 is to be mounted in the attachment space 13 from the rear and a hood portion Ma of a mating connector M is fitted in the attachment space 13 from the front.

The shield shell 20 is a metal plate member punched out into a predetermined shape and bent into a cylindrical shape with its both circumferential edges being connected (coupled) together, and has, as a whole, an elongated approximately quadrangle shape having four corners shaped into quadrant arcs, i.e., a shape which matches with the attachment space 13 of the housing 10. The shield shell 20 has a thickness of 0.4 mm and its material is brass or a heat-resisting copper alloy. Connecting portions (joint portions) 21 of the shield shell 20 are made flat by sequentially fitting a claw piece protruding from one edge end portion into two right and left engagement holes formed at the other edge portion so as to be wave form, and caulking the fitted portions of the claw piece and the engagement holes radially.

The connecting portions 21 are located at the widthwise center positions of the flat upper plate portion of the shield shell 20.

At the positions of the shield shell 20 which correspond to the coupling portions 14 of the housing 10, i.e., at the widthwise center positions of the top and bottom plate portions and the quadrant arcs at the four corners, escape portions 22 cut away rearward from the front edge in an approximately quadrangle shape are formed. The connecting portions 21 are disposed at two front and rear portions located rearward of the escape portions 22 of the top plate. Further, at the positions of the shield shell 20 which correspond to the retaining portions 15 of the housing 10, i.e., at positions on both right and left sides of the escape portions 22 of both top and bottom plates, elastic retaining pieces 23 extending rearward in a cantilever manner are formed by cutting and raising the plate portion partly inward. The elastic retaining pieces 23 are disposed at positions corresponding to the rear end portions of the front and rear escape portions 22, i.e., at positions corresponding to the coupling portions 14 in the front and rear direction with the shield shell 20 attached to the housing 10 (the depth edge positions of the attachment space 13).

At the front edges of the flat top and bottom plate portions of the shield shell 20, a plurality of elastic contact pieces 24 densely folded inward and rearward are formed at both right and left sides of the escape portion 22 (two pieces on the right-hand side to the escape portion 22 and three on the left-hand side). Likewise, at the front edges of the flat right and left plate portions of the shield shell 20, one elastic contact piece 24 densely folded inward and rearward is formed. The elastic contact piece 24 is formed with a curved portion 24*a* extending inward in a chevron form, and the curved portion 24*a* contacts the outer circumferential surface of the hood portion Ma of the mating connector M while being elastically deformed radially. As the elastic contact piece 24 is formed in a densely folded manner with respect to the shield shell 20, the space for placing the elastic contact piece 24 in the radial direction (up and down and right and left directions) is made smaller, thereby making the shielded connector F as a whole compact.

An overbending restricting portion 25 is formed at a position corresponding to the curved portion 24*a* of each elastic contact piece 24 of the shield shell 20 by partly cutting and raising the corresponding portion inward at approximately right angles. When the amount of outward elastic bending to the outer circumferential side of the curved portion 24*a* exceeds the normal bending amount, the curved portion 24*a* abuts on the overbending restricting portion 25, thereby restricting further elastic deformation. This prevents the curved portion 24*a* from being excessively bent over the elastic limit.

The front end portion of the shield member 18 is conductively connected to the shield shell 20 by using the caulk ring 30 and the underlay ring 31. The following will describe the connecting structure.

The region of the shield shell 20, which lies rear of the escape portion 22, becomes a connecting portion 26 contiguous over the entire outer circumferential surface. The aforementioned two front and rear connecting portions 21 are disposed at the connecting portion 26.

The cylindrical caulk ring 30 which, like the shield shell 20, has an approximately quadrangle shape with the four corners being shaped into quadrant arcs, is fitted over nearly the entire region of the outer circumferential surface of the connecting portion 26 (the region including both front and rear connecting portions 21). The caulk ring 30 has a thickness of set to 0.5 mm, and its material is brass. Before connection to the shield member 18, a light clearance between the inner circumferential surface of the caulk ring 30 and the outer surface of the shield shell 20 (a clearance large enough for the shield member 18 to pass) is formed.

The cylindrical underlay ring 31 which, like the shield shell 20, has an approximately quadrangle shape with the four corners being shaped into quadrant arcs, is fitted in the entire region of the inner circumference of the connecting portion 26, i.e., the region corresponding to the caulk ring 30. The sizes of the underlay ring 31 and the connecting portion 26 are set in such a way that in the fitted-in state, the underlay ring 31 does not rattle in the up and down and right and left directions (directions approximately at right angles to the inner surface of the underlay ring 31 and the outer circumferential surface of the connecting portion 26) with respect to the connecting portion 26. The thickness of the underlay ring 31 is set to 0.6 mm, and the material for the fall-off stop ring is brass. The size of the underlay ring 31 in the front and rear direction is set nearly the same as the size of the caulk ring 30.

Figure 10A:
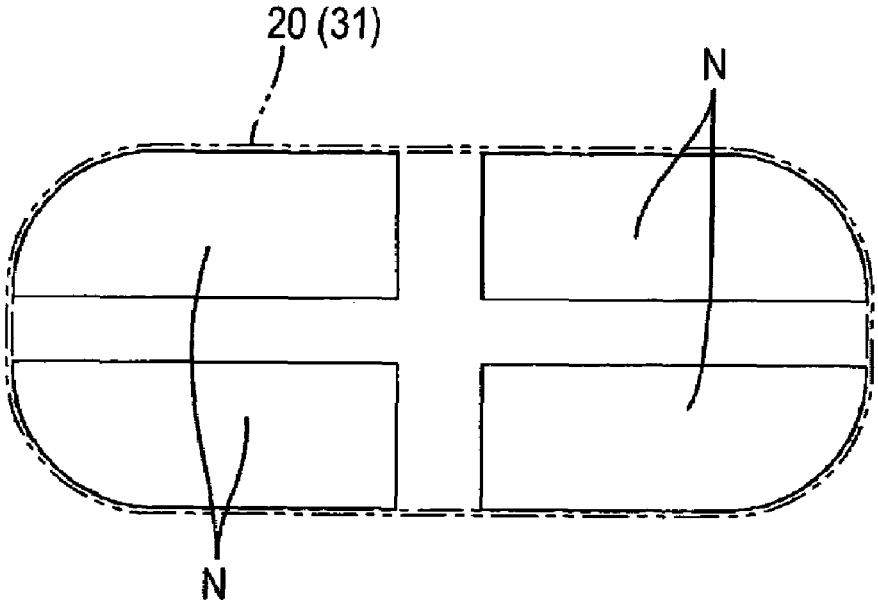
FIG. 10A is a schematic front view showing the state of a core at the time of performing caulking.

The shield member 18 is connected as follows. First, with the caulk ring 30 separated from the shield shell 20, the front end portion of the shield member 18 is placed over (fitted over) the connecting portion 26 of the shield shell 20 from the rear. Then, the caulk ring 30 is placed outside the front end portion of the shield member 18 over which the connecting portion 26 is placed, thereby holding the shield member 18 between the shield shell 20 and the caulk ring 30. The underlay ring 31 is fitted in the inner circumference of the connecting portion 26 and the outer circumference of the underlay ring 31 is made to abut on the two front and rear connecting portions 21 of the underlay ring 31. Under the state, as shown in FIG. 10A, the shield shell 20 and the underlay ring 31 are set so as to be fitted over a core N, and the caulk ring 30 is caulked to the connecting portion 26 of the shield shell 20 from the outer circumferential side. Accordingly, the front end portion of the shield member 18 is firmly held between the shield shell 20 and the caulk ring 30, connecting the shield member 18 and the shield shell 20 in a conductable manner.

Figure 10B:
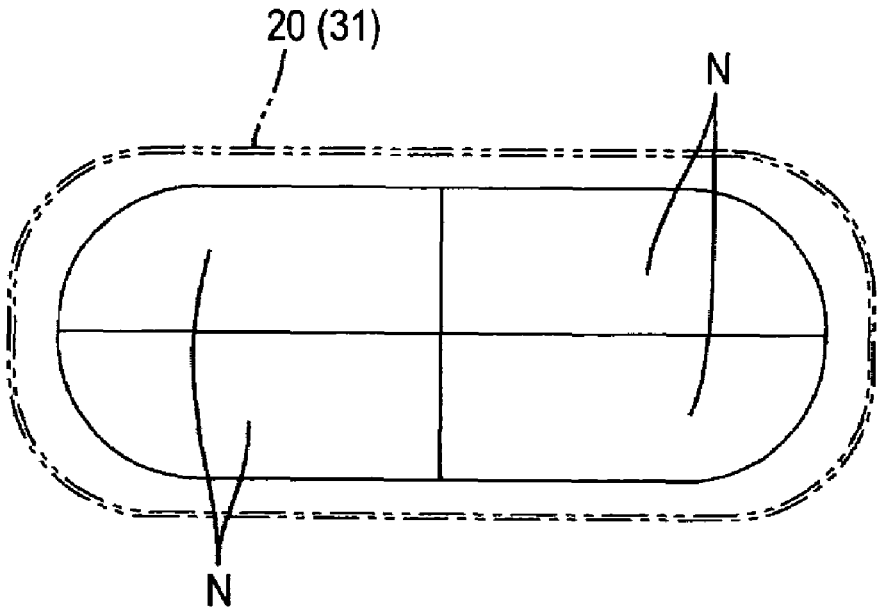
FIG. 10B is a schematic front view showing the state of the core at the time of recovering the shield shell after caulking.

In the caulking step, as shown in FIG. 10B, the core N is split into four segments separable up and down and right and left so as to be separated from the shield shell 20 after caulking, so that the core N does not correspond to the widthwise center positions of the top and bottom plate portions of the shield shell 20 (portions where the connecting portion 26 is located) and the center portions of the right and left side plate portions in the height direction. Therefore, that region of the connecting portion 26 of the shield shell 20 which does not correspond to the core N (the region including the connecting portions 21) may be inadequately or excessively deformed inward by the radially inward caulking force that is applied to the connecting portion 26 of the shield shell 20 via the caulk ring 30.

As the underlay ring 31 with a high rigidity is placed over the entire inner circumference of the connecting portion 26 of the shield shell 20, however, the deformation of the region which does not correspond to the core N after caulking takes nearly the same normal form as the region corresponding to the core N.

The shield shell 20 to which the shield member 18 is connected is connected to the housing 10 from the rear in this manner. In the attached state, the region of the shield shell 20 which is located frontward of the caulk ring 30 is retained in the attachment space 13, and the caulk ring 30 is fitted over the body portion 11 while being exposed at a location rearward of the cylindrical fitting portion 12. In the attachment space 13, the shield shell 20 is positioned along the inner circumference of the cylindrical fitting portion 12, and fitting space for fitting the hood portion Ma of the mating connector M is fitted is formed between the inner circumference of the shield shell 20 and the outer circumference of the body portion 11. The elastic contact piece 24 of the shield shell 20 faces inside the fitting space.

The mating connector M includes the hood portion Ma formed by aluminum die-cast, and a terminal holding member Mb of a synthetic resin retained in the hood portion Ma, and a male terminal Mc is attached to the terminal holding member Mb. When the hood portion Ma is fitted in the fitting space by the rotation of a lever 33 provided at the housing 10, the curved portion 24*a* of the elastic contact piece 24 elastically contacts the outer circumference of the hood portion Ma, thus allowing the shield shell 20 and the hood portion Ma to be connected together in a conductive manner and allowing the terminal fittings 16 and the male terminal Mc to be connected together in a conductive manner. In the fitted state, the region from the rear end of the housing 10 to the rear end of the hood portion Ma of the mating connector M, i.e., the region from the rear ends of the terminal fittings 16 to the connecting portions between the terminal fittings 16 and the male terminal Mc are shielded by the cylindrical shield shell 20 and the hood portion Ma.

In the attached state, the escape portion 22 is fitted over the coupling portion 14 and the rear end of the escape portion 22 abuts on the coupling portion 14 from the rear, stopping the shield shell 20 at the front with respect to the housing 10, and the elastic retaining pieces 23 ride over the retaining portions 15 and engage with the retaining portions 15 from the front, restricting the rearward separation of the shield shell 20. This holds the shield shell 20 with its displacement in the front and rear direction being restricted with respect to the housing 10.

According to the embodiment, at the time of manufacturing the shield shell 20, a thin metal plate (0.4 mm in the embodiment) is used to allow the elastic contact piece 24 to be formed in a densely folded manner, the rigidity and bending strength of the shield shell 20 become relatively low. Therefore, the shield shell 20, particularly, the connecting portion 21 positioned at the region not corresponding to the core N, may abnormally deform in the caulking step for connecting the shield member 18 to the shield shell 20, forming a clearance between the caulk ring 30 and the shield shell 20 so that the shield member 18 may fall off rearward from the shield shell 20.

According to the embodiment, however, the underlay ring 31 with a high rigidity is placed at the position on the inner circumference of the shield shell 20 which corresponds to the caulk ring 30 and receives the radially inward caulking force that is applied to the shield shell 20 from the outer surface side at the time of caulking, so that deformation of the shield shell 20 can be restricted. Accordingly, the shield member 18 can be reliably held between the shield shell 20 and the caulk ring 30, thus preventing the shield member 18 from falling off.

As the underlay ring 31 is placed directly on the connecting portion 21, which is the most deformable portion of the shield shell 20, deformation of the connecting portion 21 can be reliably prevented.

According to the embodiment, as the underlay ring receives the caulking force that is applied to the shield shell inward in the radial direction from the outer circumferential side at the time of caulking, deformation of the shield shell is restricted. This allows the shield shell and the caulk ring to reliably hold the shield member therebetween, thereby preventing the shield member from falling off the shield shell.

As the underlay ring is placed directly on the connecting portion, which is the most deformable portion of the shield shell, deformation of the connecting portion can be reliably prevented.

Other Configurations

The invention is not limited to the embodiment that has been described above with reference to the drawings, but the following embodiments, for example, may be included in the technical scope of the invention, and the invention can also be modified in various other forms without departing from the gist.

(1) Although the underlay ring has a size corresponding to the entire region of the caulk ring in the front and rear direction in the embodiment, the underlay ring may have a size corresponding to only a part of the caulk ring according to the invention.

(2) Although there is a single underlay ring in the embodiment, a plurality of underlay rings may be disposed in the front and rear direction according to the invention. In this case, the underlay rings may be disposed apart from one another in the front and rear direction or may be disposed so as to abut on one another in the front and rear direction.

(3) All of or a part of the caulk ring and the underlay ring may be retained in the housing 10 in the embodiment.

(4) In the embodiment, the underlay ring and the caulk ring may be disposed at positions apart from all the connecting portions or some connecting portions.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A shielded connector comprising:

at least four distinct layers, wherein the four distinct layers include:

a shield member having a front end, a rear end and a braided wire that encloses a bundle of a plurality of wires, the plurality of wires being drawn out of the rear end of the shield member;

a shield shell having a cylindrical shape and being fixed to the front end of the shield member;

a caulk ring disposed on an outer circumference of the shield shell to hold and fix the shield member between the shield shell by caulking; and a rigid underlay ring that has a closed shape in cross section and receives caulking force to be applied to the shield shell from an outer circumferential side of the shield shell when the caulking is performed, the underlay ring being formed separately from the shield shell and disposed on an inner circumference of the shield shell at a position corresponding to the caulk ring.

2. The shielded connector according to claim 1, wherein the caulk ring and the underlay ring are disposed at a position where the shield member and the shield shell are connected by the caulking.

3. The shielded connector according to claim 1, further comprising a housing to which at least part of the shield shell is attached.

4. A shielded connector comprising:

at least four distinct layers, wherein the four distinct layers include:

a shield member having a front end, a rear end and a braided wire that encloses a bundle of a plurality of wires, the plurality of wires being drawn out of the rear end of the shield member;

a shield shell having a cylindrical shape and being fixed to a front end of the shield member;

a caulk ring disposed on an outer circumference of the shield shell to hold and fix the shield member between the shield shell by caulking;

a rigid underlay ring that has a closed shape in cross section and receives caulking force to be applied to the shield shell from an outer circumferential side of the shield shell when the caulking is performed, the underlay ring being formed separately from the shield shell and disposed on an inner circumference of the shield shell at a position corresponding to the caulk ring; and a housing to which at least part of the shield shell is attached, wherein the housing includes:

a body portion that retains a plurality of terminal fittings each attached to an end of the corresponding wires;

a cylindrical fitting portion that encloses the body portion; and a coupling portion that couples the body portion and the cylindrical fitting portion.

5. The shielded connector according to claim 4, wherein the shield shell is attached to the housing by inserting at least part of the shield shell into the cylindrical fitting portion.

6. The shielded connector according to claim 4, wherein the shield shell is provided with an escape portion formed by cutting away rearward from a front edge of the shield shell, the escape portion being provided to be fitted over the coupling portion.

7. The shielded connector according to claim 4, wherein the body portion is provided with a retaining portion that projects from the body portion, and wherein the shield shell is provided with an elastic retaining piece integrally formed therewith, the elastic retaining piece being provided to be retained to the retaining portion.

8. The shielded connector according to claim 4, wherein the shielded shell is provided with an elastic contact piece integrally formed therewith, the elastic contact piece being provided to be in contact with an outer circumferential surface of a hood portion of a mating connector.

9. The shielded connector according to claim 4, wherein the housing is provided with a lever to engage connection between the mating connector and the housing.

10. The shielded connector according to claim 4, wherein the housing comprises a female terminal.

* * * * *